United States Patent [19]

Kart

[11] 4,127,056

[45] Nov. 28, 1978

[54] AUTOMATIC PISTOL BARREL LOCKING DEVICE AND SUB-CALIBER CONVERSION THEREFOR

[75] Inventor: Frederick H. Kart, Riverhead, N.Y.

[73] Assignee: Kart Sporting Arms Corporation, Riverhead, N.Y.

[21] Appl. No.: 811,629

[22] Filed: Jun. 30, 1977

[51] Int. Cl.[2] ..... F41C 5/00

[52] U.S. Cl. ..... 89/128; 42/75 B; 89/196

[58] Field of Search ..... 89/29, 128, 163, 196; 42/75 B, 77

[56] References Cited

U.S. PATENT DOCUMENTS

| | | | |
|---|---|---|---|
| 3,657,959 | 4/1972 | Kart | 89/128 |
| 3,724,326 | 4/1973 | Day | 42/77 |

FOREIGN PATENT DOCUMENTS

| | | | |
|---|---|---|---|
| 1,040,420 | 10/1958 | Fed. Rep. of Germany | 89/196 |

*Primary Examiner*—Stephen C. Bentley
*Attorney, Agent, or Firm*—Cooper, Dunham, Clark, Griffin & Moran

[57] ABSTRACT

The invention provides a barrel locking device for automatic pistols, and a sub-caliber conversion therefor. The essential elements of the locking device are the barrel, the aligning cheeks at the rear end of the barrel, the barrel extension member, a link pivotally connected to such barrel extension member and having a hole therein, a slide-stop having a pivot pin for engagement in a transverse through hole in the piston receiver and in the hole in the link, and a barrel locking screw which engages in a threaded hole in the front face of the extension member. Upon tightening of the barrel locking screw the link is rotated forwardly and pulls the barrel and slide into intimate contact with the receiver by engagement of the barrel cheeks with the upper surface of the receiver.

10 Claims, 8 Drawing Figures

Fig. 3.
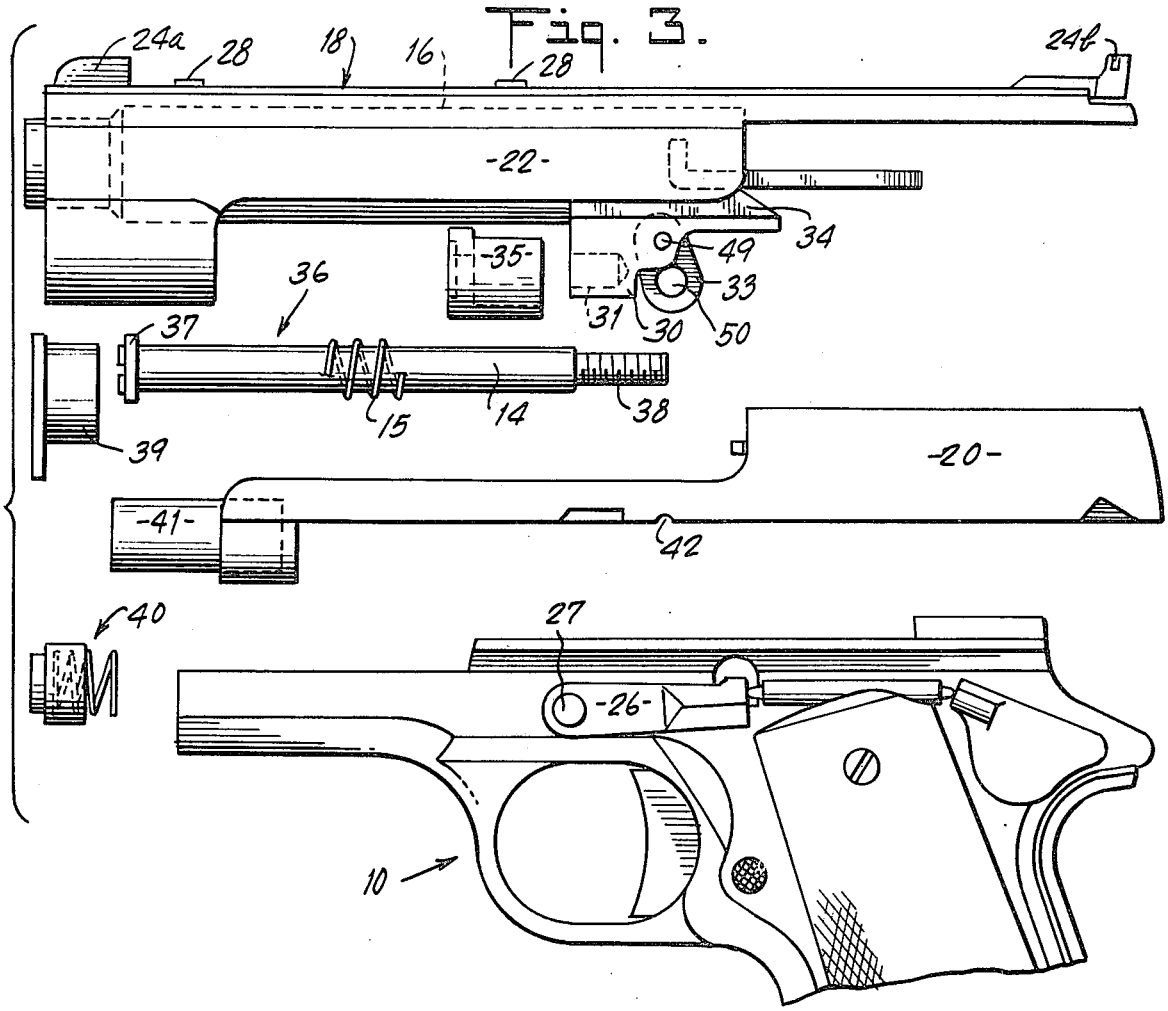
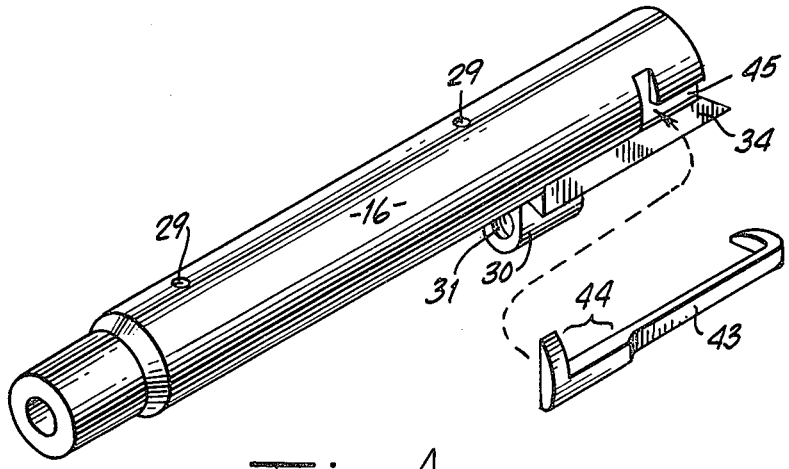
Fig. 4.

-14-
-46-
6
7
8
8
6
7
8
36
39
40
37
41
47
48
35
50
49
27
33
30
B
16
51
34
30
49
49a
27
33
10
28
22
45
44
34
52
26
50
30
36
31
35
15
36

AUTOMATIC PISTOL BARREL LOCKING DEVICE AND SUB-CALIBER CONVERSION THEREFOR

The invention also provides for sub-caliber conversion of the automatic pistol by encompassing the barrel extension member with a barrel bridge member having a front wall of predetermined thickness. The recoil spring bears against the front wall of such barrel bridge member and the recoil action of such spring is limited by the thickness of such wall. For sub-caliber conversion the invention also modifies the slide by partially sectioning it longitudinally in horizontal planes to form two sub-assemblies. The two sub-assemblies can also be provided by new manufacture of the two pieces. On such sub-assembly comprises the barrel shroud and sights to which a sub-caliber barrel is securely fastened. The other sub-assembly comprises the slide for the sub-caliber conversion. During cocking and firing it moves longitudinally with respect to the shroud-barrel sub-assembly and the receiver.

The present invention relates to automatic pistols, and more particularly to a barrel locking device for automatic pistols, and to a sub-caliber conversion of automatic pistols.

In my prior U.S. Pat. No. 2,657,959 I have shown a Colt automatic pistol caliber .45, Government model, converted to a .22 caliber pistol by use of a Colt conversion kit. I have also shown modifications which I have made in such Colt .45 after conversion by the use of such Colt conversion kit to a .22 caliber piston, to impart to such .22 conversion a high degree of accuracy such that it is at least as accurate, if not more accurate than a .45 caliber piston which has been modified individually by a gunsmith for use in competitive target shooting.

Among the modifications disclosed in my U.S. Pat. No. 3,657,959 is the provision of a substitute .22 caliber barrel having at its rearward end two longitudinally-disposed aligned checks which are brought into firm engagement with the upper surface of the pistol receiver and which thereby assures pistol accuracy independently of the tolerances between the slide and the receiver.

Another modification disclosed in my said patent is a downwardly projecting extension member on the barrel having an upwardly inclined elongated slide-stop hole, and also having a screwthreaded hole in the front end of the extension member which is in alignment with the recoil spring guide, such screwthreaded hole being in communication with the upwardly inclined elongated slid-stop hole, and a locking screw extending through such recoil spring guide and into such screwthreaded hole in the front of the barrel member with the head of the screw bearing against the recoil spring guide which in turn bears against the receiver, whereby upon tightening of the screw the barrel is pulled forwardly, the slide-stop pin rides upwardly along the elongated slide-stop hole, the barrel is forced downwardly and the aligning cheeks are brought into firm contact with the receiver.

Another modification disclosed in my said patent is an improved slide-stop which permits the slide-stop bar to turn on the pin.

Some of the foregoing modifications as disclosed in my said patent are availed of in the automatic pistol of the present invention.

One of the features of the present invention is a barrel locking device for locking the barrel securely to the receiver of the Colt automatic pistol. While the barrel locking device is especially useful on a .22 caliber conversion of a Colt .45, it is also usable on other caliber barrels Another feature of my invention is the provision of a modified slide partially sectioned longitudinally in horizontal planes to form two sub-assemblies. The two sub-assemblies can also be provided by new manufacture of the two pieces. One such sub-assembly comprises a barrel shroud with sights and the other sub-assembly comprises the slide which during cocking and firing moves longitudinally with respect to such shroud sub-assembly and the receiver.

By sectioning the slide for the .22 conversion and other sub-caliber conversions I eliminate approximately 50% of the weight of the slide during the firing of the pistol. The lower sub-assembly of the slide is the only part that moves during firing; whereas, the upper section with the barrel affixed thereto remains stationary. Hence the reaction from firing only has to move approximately 50% of the weight of metal as compared with what was moved prior to such sectioning.

With the heavier weight slide and barrel assembly the reaction on firing a .22 caliber bullet was somewhat sluggish and the ejecting-feeding mechanism did not have as positive operation as with the present invention. With the sectioned slide of the present invention and the movement of considerably less metal during firing, a more violent reaction is obtained so that the extracting-ejecting operation and the feeding of new cartridges has more energy.

Another feature of the present invention is the provision of what I prefer to call a "barrel bridge member" which is disposed forwardly of the barrel extension member and is adapted to be slid over said barrel extension member to encompass the same but is held slightly out of engagement therewith by a rearward shoulder on the barrel bridge member which engages the shoulder provided on the receiver. The barrel bridge member is a wholly new part added to the pistol and eliminates the use of spacers as shown in my U.S. Pat. No. 3,657,959, when converting a .45 caliber pistol to a .22 caliber or other sub-caliber pistol. The length of the barrel bridge member is determined by the amount of change required to shift from one caliber pistol to the other.

The foregoing and other features of the invention are disclosed in the accompanying drawings wherein:

FIG. 3 is an exploded view in side elevation of the pistol of FIG. 1.

FIG. 4 is a perspective view of the barrel and the ejector.

Figure 1:
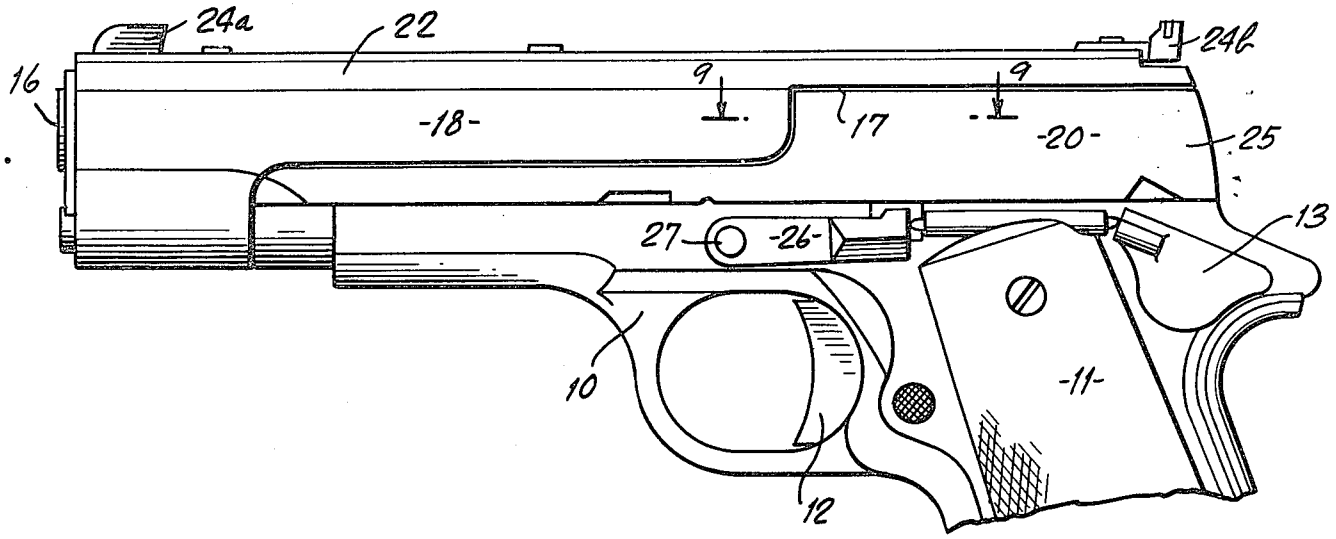
FIG. 1 is a side elevational view, partially fragmentary, of an automatic pistol constructed according to the present invention which is in its cocked position.
Figure 2:
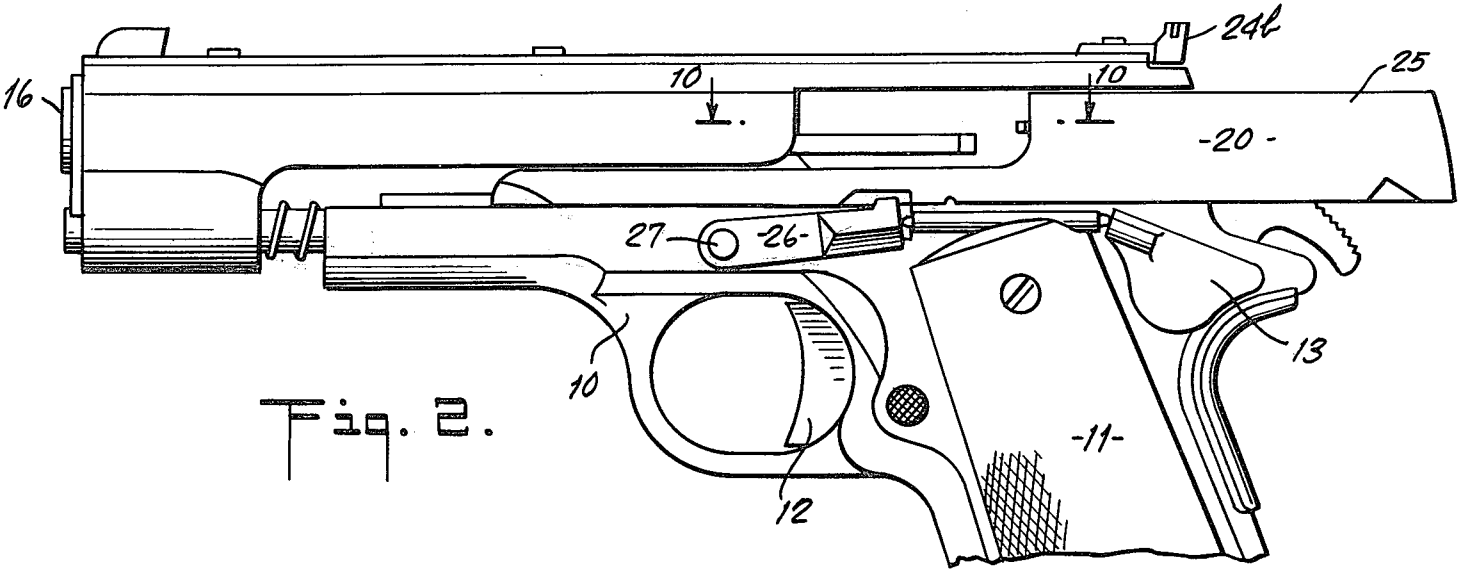
FIG. 2 is a view similar to FIG. 1 but showing the pistol in its uncocked position.

Referring now to the drawings for a more complete understanding of the improvements made by the present invention it will first be noted from FIGS. 1 and 2 which illustrate the well-known Colt automatic pistol, caliber .45, Government model, converted according to the present invention to a .22 caliber pistol, that such pistol includes the basic elements of: a receiver 10, having a grip portion 11, a trigger 12, a safety 13, a recoil spring guide 14, a recoil spring 15 surrounding such guide, and a barrel 16 from which the bullet is ejected. In the well-known Colt .45 a slide is disposed over such barrel and is in sliding engagement with the receiver 10. According to the present invention, however, the slide has been sectioned longitudinally and horizontally as shown at 17 to provide an upper sub-assembly 20. The upper sub-assembly has a barrel shroud 22 having sights 24*a*, 24*b* mounted thereon. The lower sub-assembly has a slide 25 which when the pistol is cocked assumes the position shown in FIG. 1 and in the uncocked position assumes the position shown in FIG. 2.

The pistol also has a slide-stop 26 constructed similarly to the slide-stop shown in FIG. 4 of my U.S. Pat. No. 3,657,959 and which has pin 27 which permits the bar of the slide-stop and the pin to pivot or rotate relatively to each other.

Referring now to FIG. 3, which is an exploded view of the pistol shown in FIGS. 1 and 2, the upper section 18 consisting of the shroud 22 and sights 24*a* 24*b* has mounted within it the barrel 16 which is shown in perspective in FIG. 4. The barrel is secured to the shroud by screws 28, 28 which fit into screwthreaded holes 29, 29 provided in the upper surface of the barrel. The barrel has integrally formed therewith a downwardly projecting barrel extension member 30 similarly to the barrel extension member disclosed in my earlier patent. The barrel extension member has a screwthreaded hole 31 in its front face and also has pivoted to it a link 33 forming part of the barrel locking mechanism which will later be described. The barrel 16 has been provided on each side with cheeks 34 similar to the cheeks provided in my earlier patent, such cheeks having been accurately ground to provide guiding edges which engage the upper surface of the receiver 10 and serve the same function and purposes as the cheeks of my prior patent.

In FIG. 3 there is shown forwardly of the barrel extension member 30 what I prefer to a "barrel bridge member" 35 adapted to engage over the barrel extension member for a purpose which will later be described.

A barrel locking screw 36 has a slotted head 37 and a reduced threaded end 38, and has the recoil spring 15 surrounding the main body of such screw which serves as the spring guide 14. A barrel bushing 39 cooperates with a barrel bushing retainer and spring 40 for purposes later to be described.

The lower section 20 of the Colt .45 conventional slide which has been sectioned along the line 17 constitutes the slide of the present automatic pistol. At its outer end it has been provided with a recoil spring retainer 41. It also has a semi-circular clearance recess 42. The conventional Colt .45 receiver is shown at 10 in the exploded view, FIG. 3, plus the slide-stop 26 which is shown in my earlier patent.

In FIG. 4, which shows the barrel in perspective, there is also shown an ejector 43 which has an L-shaped portion 44 adapted to be fitted into an L-shaped cutout 45 in the face of the barrel at its rear end.

It will be understood that the barrel of the present invention is specially constructed to include screw holes 29, the barrel extension member 30 with the screwthreaded hole 31 in the front face, the cheeks 34 on each side of the barrel for engagement with the upper surface of the receiver 10, and the L-shaped cutout 45 for accommodating the ejector 43.

Figures 5, 6, 7, 8:
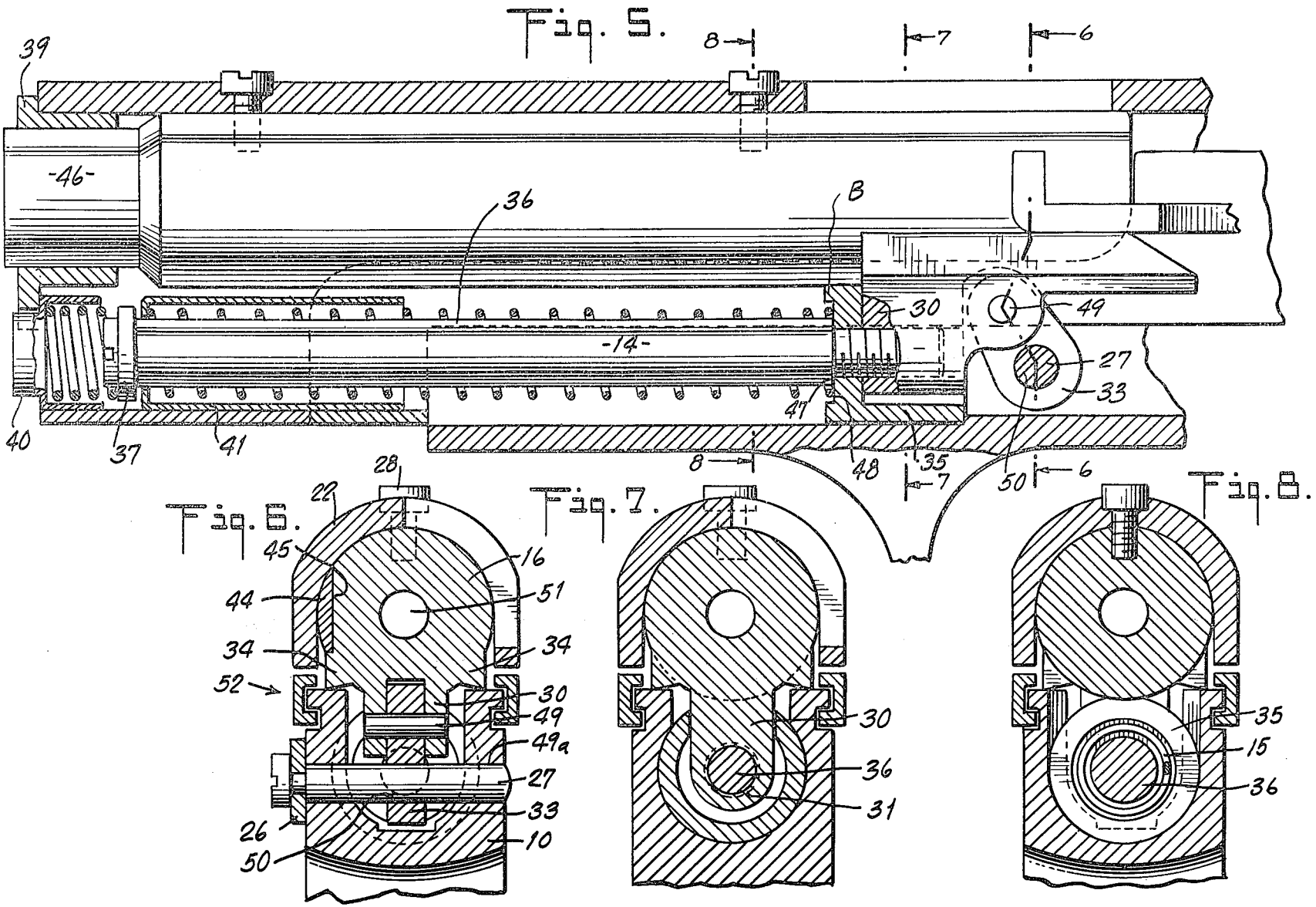
FIG. 5 is a vertical longitudinal sectional view of the pistol of FIG. 1 with certain parts being shown in elevation.
FIG. 6 is a cross-sectional view of the pistol of FIG. 5 taken along the line 6—6 and viewed in the direction of the arrows.
FIG. 7 is a cross-sectional view of the pistol of FIG. 5 taken along the line 7—7 and viewed in the direction of the arrows.
FIG. 8 is a cross-sectional view of the pistol of FIG. 5 taken along the line 8—8 and viewed in the direction of the arrows.

By referring to FIG. 5 it will be seen that barrel bushing 39 engages over the reduced end 46 of the barrel and also holds the barrel bushing retainer 40 in position in engagement with the head 37 of locking screw 36 which also serves as the spring guide 14.

The head 37 of the locking screw 36 is disposed outside of the recoil spring retainer 41. The opposite end of the screw has a shoulder 47 which bears against a recess 48 in the face of the barrel bridge member 35. The end convolution of the recoil spring 15 also bears against such recess in the face of the barrel bridge member 35. As seen in FIG. 5 the barrel bridge member 35 is disposed over the barrel extension member 30 and is brought into engagement therewith by tightening of the locking screw 36 which is threaded into screwthreaded hole 31 in barrel extension member 30. Link 33 is pivotally connected to the barrel extension member by pivot pin 49. The link 33 also has a hole 50 for receiving the pin 27 of the slide-stop 26.

It will be noted that the front face of the barrel bridge member 35 has a depth of metal B which spaces the end convolution of the recoil spring away from the barrel extension member 30. This depth of metal reduces the length of recoil action when the Colt .45 is converted to a sub-caliber pistol. It serves the same function as the spacers shown in my prior patent. With various sub-calibers the depth of the metal B will vary.

In FIG. 6, which is a cross section taken along the line 6—6 of FIG. 5, looking in the direction of the arrows, the shroud 22 is shown as secured to the barrel 16 by screw 28, the barrel having a bore 51. The L-shaped end 44 of the ejector 43 is shown as mounted in the L-shaped cutout 45 and is held in place by its engagement with the shroud 22. The conventional groove and flanges as used on the .22 caliber Colt conversion slide and on the Colt .45 caliber receiver are shown at 52. The barrel extension member 30 has pivot pin 49 mounted therein which supports the link 33. The pin 27 for the slide-stop 26 is mounted in the lower hole of link 33 and in the through hole 49*a* in the receiver 10 which coincides with hole 50. The cheeks 34 engage the upper surface of the receiver 10.

In FIG. 7, which is a cross-sectional view taken along the line 7—7 of FIG. 5, looking in the direction of the arrows, the barrel extension member 30 with the screwthreaded end of the barrel locking screw 36 is shown in engagement with the screwthreaded hole 31 of the barrel extension member.

In FIG. 8, which is a cross section taken along the line 8—8 of FIG. 5, looking in the direction of the arrows, the front face of the barrel bridge member 35 is shown in full lines as is one coil of the recoil spring 15. The body of the barrel locking screw 36 is shown in cross section.

As mentioned earlier one of the features of the present invention is the barrel locking device for locking the barrel securely to the receiver of a Colt automatic pistol. The essential elements of such automatic locking device as herein shown are: the barrel 16, the cheeks 34, the extension member 30, the link 33, the slide-stop 26 and the barrel locking screw 36. This combination of elements can be used with any caliber pistol for locking the barrel into a fixed relation with the receiver. For sub-caliber pistols the barrel bridge member 35 is also essential to the barrel locking device.

In operation the barrel locking device functions as follows:

Link 33 has a lever action as it is rotated forwardly around the slide-stop pin hole 50 and pulls the slide barrel and slide shroud assembly into intimate contact with the receiver, — the actual contact being made by the barrel-aligning cheeks 34 with the top surface of the receiver 10. Forward rotation of the link 33 is limited by the cheeks 34 coming in contact with the receiver.

The manufacture of the target pistol conversion is done as follows:

First the Colt manufactured slide is sectioned into two pieces along the section line 17 to provide the shroud 22 and the lower sub-assembly 20. As before stated the shroud 22 and the lower sub-assembly 20 can also be provided by new manufacture of the two pieces. The barrel as shown in FIG. 4 is then manufactured, the barrel having a barrel extension member 30, a hole in the barrel extension member for the barrel link pin 49, the threaded hole 31 for the barrel locking screw 36, the threaded holes 29 for the screws 28, the barrel aligning cheeks 34, and the L-shaped cutout 45 to receive the forward end of the ejector 43.

By inserting the ejector 43 into the cutout 45 and then inserting the barrel 16 into the barrel shroud 22 and fastening with screws 28 and then attaching the barrel link 33 and the barrel link pin 49 the upper sub-assembly 18, as shown in FIG. 3, is then completed.

Next the spring retainer 41 is fixed to slide 20 at its front end and the Colt manufactured firing pin and spring assembly 55 and the extractor 54 and the firing pin and extractor retainer manufactured by Colt or newly manufactured are inserted to complete the slide sub-assembly.

To complete the entire assembly, one end of the recoil spring 15 is inserted in the recoil spring retainer 41 and the other end is pressed against the barrel bridge member 35 which encompasses the barrel extension member 30. Next the barrel locking screw 36 is inserted from the front end of the barrel shroud 22 through the opening in the recoil spring retainer 41, the recoil spring 15, and through the barrel bridge member 35, and is started into the threads of the screwthreaded hole 31 in the barrel extension member 30. At this stage the unit is ready to be installed on the receiver.

To install on the receiver the complete assembly is slid onto the guide slots conventionally provided in the receiver. After aligning the hole 50 in the link 33 with its matching hole **49*a* in the receiver the slide-stop pin 27 is inserted in such holes. By tightening the barrel locking screw 36 the complete assembly is forced forward as the shoulder on the locking screw contacts the barrel bridge member 35. When all clearances have been taken up by tightening the screw, the barrel link 33 restricts further forward motion and exerts a downward force on the barrel assembly, engaging the barrel aligning cheeks forcibly and securely with the top of the receiver. By then installing the barrel bushing 39 over the barrel and the barrel bushing retainer and spring 40 against the head of the barrel locking screw 36** and fitting them in their relative positions, the pistol assembly is completed.

It should be noted that one important advantage of the pistol herein disclosed is that the sight assembly and the barrel are fixed in relation to each other, assuring the optimum in accuracy. Also, by using the barrel link as shown, friction loss is at a minimum, allowing more force to be brought in a downward direction assuring a tighter and more secure lock between the barrel and the receiver. In addition, the overall appearance of the pistol is very pleasing to the eye as it retains the original dimensions with very minor changes.

What I claim is:

1. An automatic pistol having a receiver, a slide and a barrel, with said slide mounted for recoiling movement relative to said barrel and receiver, said receiver and slide having interfitting grooves and flanges, said receiver having an upper surface above said interfitting grooves and flanges on each side of said barrel which parallels the axis of said barrel, said barrel having on each exterior side wall adjacent its rearward end an aligning cheek extending forwardly from said rearward end, parallel to the axis of said barrel, each cheek having a lower surface adapted for engagement with one of said upper surfaces of said receiver, said barrel having a downwardly projecting extension member with a screw threaded hole in the front face, a recoil spring, and a slide-stop including a pivot pin, characterized in that:

(a) a link is pivotally connected to said barrel extension member and has a hole therein which is adapted to coincide with a transverse hole in said receiver, and (b) a locking screw disposed within the recoil spring and threadedly engaged in the threaded hole in the front face of the barrel extension member, said locking screw upon tightening thereof serving to rotate the link forwardly and thereby to pull the barrel and slide assembly into intimate contact with the receiver.

2. An automatic pistol according to claim 1, wherein the barrel aligning cheeks make the intimate contact with the top surface of the receiver.

3. An automatic pistol according to claim 1, which has been converted to a sub-caliber pistol, further characterized in that:

(c) a barrel bridge member encompasses said barrel extension member, said barrel bridge member having a front wall of predetermined thickness which engages one end of the recoil spring and thereby limits the amount of recoil.

4. An automatic pistol according to claim 3, wherein the barrel bridge member has a recess in its face to accommodate the end coil of the recoil spring, and also has a through hole to accommodate the screwthreaded end of the barrel locking screw.

5. An automatic pistol according to claim 4, characterized in that:

(d) a spring retainer is provided for the opposite end of the recoil spring, and said barrel locking screw extends through said spring retainer, and (e) said barrel locking screw has an enlarged, slotted head at one end, and a shoulder at its other end which engages the recess in the face of the barrel bridge member, the screwthreaded end of the barrel locking screw being of reduced diameter to provide such shoulder.

6. An automatic pistol according to claim 1, wherein the slide is composed of two sub-assemblies, one such sub-assembly comprising the barrel shroud with sights, and the other sub-assembly comprising the slide which during cocking and firing moves longitudinally with respect to such shroud sub-assembly and the receiver.

7. An automatic pistol according to claim 1, wherein the slide is partially sectioned longitudinally and horizontally to form two sub-assemblies, one such sub-assembly comprising the barrel shroud with sights, and the other sub-assembly comprising the slide which during cocking and firing moves longitudinally with respect to such shroud sub-assembly and the receiver.

8. An automatic pistol according to claim 6, wherein the barrel is of sub-caliber bore and is firmly connected to the shroud.

9. An automatic pistol according to claim 1, wherein the slide is partially sectioned longitudinally and horizontally to form two sub-assemblies, one such sub-assembly comprising the barrel shroud with sights, and the other sub-assembly comprising the slide which during cocking and firing moves longitudinally with respect to such shroud sub-assembly and the receiver, a sub-caliber barrel firmly connected to said shroud, and a barrel bridge member encompassing said barrel bridge extension member and having a front wall which engages one end of the recoil spring, said wall being of such predetermined thickness as to compensate for the sub-caliber of the pistol and to limit the amount of recoil.

10. An automatic pistol according to claim 9, wherein the locking screw extends through said barrel bridge member into said barrel extension member, and that upon tightening of said screw, the shroud, barrel and slide are brought into intimate contact, the aligned cheeks on the barrel making such intimate contact with the upper surfaces of the receiver.

* * * * *

UNITED STATES PATENT AND TRADEMARK OFFICE

CERTIFICATE OF CORRECTION

PATENT NO. : 4,127,056

DATED : November 28, 1978

INVENTOR(S) : FREDERICK H. KART

It is certified that error appears in the above-identified patent and that said Letters Patent are hereby corrected as shown below:

ABSTRACT

Line 8, change "piston" to --- pistol ---

SPECIFICATION

Column 1, line 15, change "On" to --- One ---; line 26, correct the patent number to read "3,657,959"; line 31, change "piston" to --- pistol ---; line 40, change "checks" to --- cheeks ---; line 52, change "slid-stop" to --- slide-stop ---

Column 3, line 37, change "similarly" to --- similar ---; line 50, after "to" insert --- call ---

Signed and Sealed this

*Seventeenth* Day of *April 1979*

[SEAL]

*Attest:*

RUTH C. MASON
*Attesting Officer*

DONALD W. BANNER
*Commissioner of Patents and Trademarks*